US009247365B1

(12) United States Patent
Ellis et al.

(10) Patent No.: US 9,247,365 B1
(45) Date of Patent: Jan. 26, 2016

(54) IMPEDANCE SENSING FOR SPEAKER CHARACTERISTIC INFORMATION

(71) Applicant: Google Inc., Mountain View, CA (US)

(72) Inventors: Shawn Ellis, Sunnyvale, CA (US); Jonathan Switkes, San Jose, CA (US)

(73) Assignee: Google Inc., Mountain View, CA (US)

( * ) Notice: Subject to any disclaimer, the term of this patent is extended or adjusted under 35 U.S.C. 154(b) by 154 days.

(21) Appl. No.: 13/766,820

(22) Filed: Feb. 14, 2013

(51) Int. Cl.
*H04R 29/00* (2006.01)

(52) U.S. Cl.
CPC ..... *H04R 29/001* (2013.01)

(58) Field of Classification Search
None
See application file for complete search history.

(56) References Cited

U.S. PATENT DOCUMENTS 5,226,089 A 7/1993 Yoon et al.
6,185,627 B1 2/2001 Baker et al.
6,359,987 B1 3/2002 Tran et al.
6,870,934 B2 3/2005 Krochmal et al.
7,099,481 B2 8/2006 Baker et al.
7,792,310 B2 9/2010 Lee et al.
8,189,816 B2 5/2012 Solow
8,515,090 B2 * 8/2013 Morishima et al. ..... 381/71.6
2002/0149424 A1 * 10/2002 Honda ..... 330/207 A
2002/0149426 A1 * 10/2002 Honda ..... 330/251
2005/0175195 A1 8/2005 Cheney, Jr. et al.
2008/0318629 A1 12/2008 Inha et al.
2011/0033056 A1 2/2011 Johnson et al.

* cited by examiner

*Primary Examiner* — Paul Huber
(74) *Attorney, Agent, or Firm* — Morris & Kamlay LLP

(57) ABSTRACT

Speakers (e.g. "loudspeakers") from different manufactures may have differing characteristics. In order to improve audio performance, an audio system may customize audio settings based on characteristics of an attached speaker. Described is a technique for determining speaker characteristics by sending a signal through a filter of the attached speaker. The signal may be a probing signal that produces no audible effect from the speaker. The signal may progress through one or more frequency ranges and an impedance signature may be measured. When the signal progresses through a frequency range, the impedance may be measured and a speaker model type and/or characteristics or condition of the speaker may be determined based on the measured impedance.

20 Claims, 6 Drawing Sheets

IMPEDANCE SENSING FOR SPEAKER CHARACTERISTIC INFORMATION

BACKGROUND

Media devices such as audio/video receivers are often connected to separate speaker systems. Components in these devices often include a Digital Signal Processor (DSP) and an amplifier to process audio/video and drive speakers. When pairing speakers to the media device, users are usually not limited to a particular speaker manufacturer and may choose speakers from a selection of varying quality and characteristics. Each speaker model may have particular strengths and weaknesses which may be optimized by properly tuning DSP settings. Determining these settings often requires an elaborate process of entering information into the media device or manually adjusting settings. Without completing this inconvenient process, optimal sound reproduction may not be achieved.

BRIEF SUMMARY

Described are techniques and systems for determining characteristics of a speaker by measuring impedance produced by the speaker through a frequency range. In an implementation, a probing signal may be sent through a filter of the speaker. The filter may include a passive audio crossover. The probing signal may not produce an audible effect from the speaker and may progress through either an infrasonic or ultrasonic frequency range. An impedance signature generated by the filter may be measured during the duration of the signal. A characteristic, which may include a model type of the speaker, may be determined based on the measured impedance signature.

In an implementation, one or more characteristics of a speaker may be determined by measuring an impedance-frequency relationship. A signal may be sent through a filter of the speaker and the signal may progress through a predefined frequency range. The predefined range may include a first frequency range and a second frequency range. Impedance during the duration of the signal may be measured and may vary based on the filter during the first frequency range. An impedance-frequency relationship may be generated based on the measured impedance and a characteristic may be determined based on the generated relationship during the first range. The determined characteristic may include an impedance, frequency response, sensitivity, dispersion, driver type, number of drivers, size, and an enclosure type, among other characteristics. In addition, diagnostic information such as an indication of whether a particular driver is damaged may be determined based the generated relationship during the second range.

In an implementation, a device may determine one or more characteristics of a speaker by measuring impedance. A processor may send a probing signal through a filter of the speaker. The probing signal may not produce an audible effect from the speaker and may progress through either an infrasonic or ultrasonic frequency range. An impedance signature generated by the filter may be measured during the duration of the signal. A characteristic, which may include a model type of the speaker, may be determined based on the measured impedance signature.

BRIEF DESCRIPTION OF THE DRAWINGS

The accompanying drawings, which are included to provide a further understanding of the disclosed subject matter, are incorporated in and constitute a part of this specification. The drawings also illustrate implementations of the disclosed subject matter and together with the detailed description serve to explain the principles of implementations of the disclosed subject matter. No attempt is made to show structural details in more detail than may be necessary for a fundamental understanding of the disclosed subject matter and various ways in which it may be practiced.

DETAILED DESCRIPTION

Speakers (e.g. "loudspeakers") from various manufactures may have differing characteristics. In order to improve audio performance, a media device may customize DSP settings based on characteristics of an attached speaker. In implementations of the disclosed subject matter, these characteristics may be determined by sending a signal through a filter of an attached speaker and measuring impedance. The signal may be a probing signal that produces no audible effect from the speaker. The signal may progress through one or more frequency ranges. When the signal progresses through a frequency range, the impedance may be measured and an impedance-frequency relationship may be generated. The relationship may include, for example, an impedance vs. frequency curve. This relationship may be generated and analyzed to determine characteristics of the speaker. For example, characteristics such as the number, size, frequency response, resonance frequency, and nominal impedance of the drivers may be determined by analyzing the generated curve.

It may also be possible to identify a particular speaker model by measuring impedance. For example, the speaker may be equipped with an identification filter or other components that respond to a particular frequency range in a unique manner to create a unique impedance signature. This signature may then be used to identify the particular speaker model. By determining the specific speaker model, audio settings may be optimized to account for the specific design, hardware configuration, and/or capabilities unique to the speaker.

In the techniques described above, the frequency range of the signal may be within a typical frequency range of audio output (e.g. music), or it may be outside of an audible range such that the response of the speaker is not perceptible to a user. For example, the frequency range of infrasound and ultrasound are typically not perceptible by a human.

Figure 1:
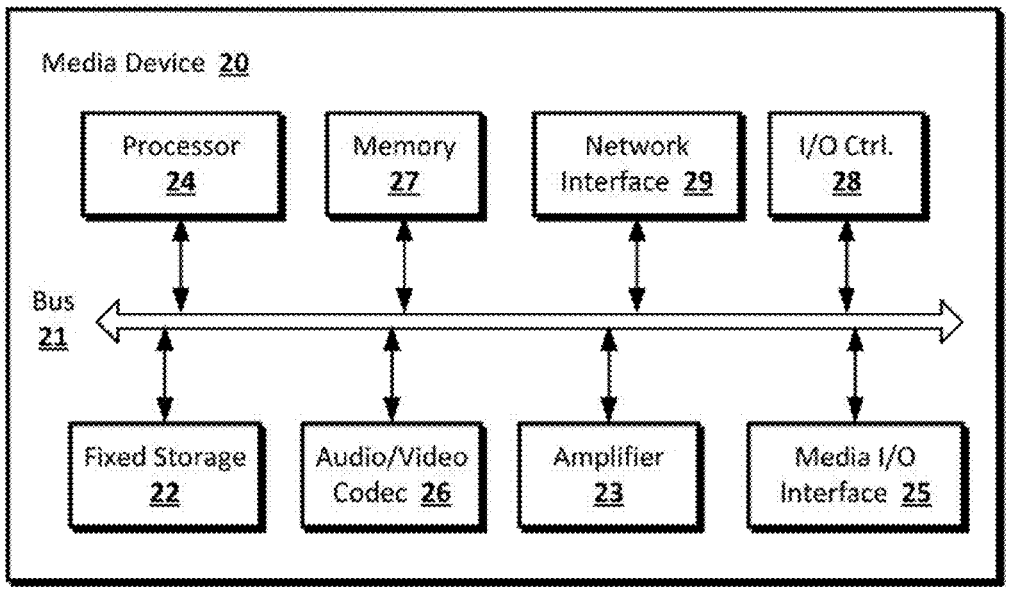
FIG. 1 shows a media device according to an implementation of the disclosed subject matter.

FIG. 1 shows a media device according to an implementation of the disclosed subject matter. The media device 20 includes a bus 21 which interconnects components of the media device 20, such as one or more processors 24 (including digital signal processors), fixed storage 22, an amplifier 23, a media I/O interface 25, an audio/video codec 26, memory 27, an input/output (I/O) controller 28, and a network interface 29.

The bus 21 allows data communication between the processor 24 and the memory 27, which may include random access memory (RAM), read-only memory (ROM), flash memory, and the like. An operating system and application programs may be stored in the memory 27 or may be stored on a fixed storage 22. The fixed storage may be a hard drive, solid-state drive, flash drive, and the like. The fixed storage 22 may be integral with the media device 20 or may be separate and accessed through an interface. The fixed storage 22 may also include removable media operative to control and receive an optical disk, flash drive, USB drive, and the like.

The network interface 29 may allow the media device 20 to communicate with other user devices via one or more local, wide-area, or other networks using wired or wireless techniques. For example, the network interface 29 may provide such connection using wireless techniques, including Wi-Fi, Bluetooth™, digital cellular telephone connection, Cellular Digital Packet Data (CDPD) connection, digital satellite data connection or the like.

The media device 20 may include a media I/O interface 25, for connecting audio and video components. The interface 25 may include connections for USB, micro USB, HDMI, micro HDMI, composite video, component video, S-video, VGA, DisplayPort, FireWire, S/PDIF via coaxial or optical cables, "RCA" connectors, and the like. The media I/O interface 25 may also include speaker connections for speaker wire, The speaker connections may include various analog connections, multichannel connections (e.g. 5.1, 7.1, including subwoofer connections), and various other connectors for speaker wire, including various binding posts such as banana plugs, pin connectors, bare wire clamps, lug terminals, and the like including proprietary wiring arrangements.

The media device 20 may include an amplifier 23. The amplifier 23 may be an electronic amplifier that amplifies lower power audio signals to a level suitable for driving a speaker. The amplifier 23 may have associated characteristics including a power rating (e.g. 25 Watts, 50 Watts, etc.), number of channels, gain, bandwidth, efficiency, linearity, noise, range, slew rate, rise time, stability, and the like. These characteristics may be optimized based on retrieved characteristic information of a device coupled to the media device 20. The media device 20 may also include components related to the stages that may precede amplification of an audio signal including pre-amplification, tone control, mixing/effects, and the like.

The media device 20 may include an audio/video codec 26 that encodes analog audio as digital signals and decodes digital back into analog. Accordingly, it may include both an Analog-to-Digital converter (ADC) and Digital-to-Analog converter (DAC).

Other devices or components may be part of or connected to the media device 20 (e.g. TV, digital camera, and the like). Conversely, all of the components shown in FIG. 1 need not be present to practice the present disclosure. The components can be interconnected in different ways from those shown. The operation of a media device 20 such as that shown in FIG. 1 is readily known in the art and is not discussed in detail in this application. Code to implement the present disclosure may be stored in a computer-readable storage media such as a memory 27 or fixed storage 22, which may be local or remote.

Figure 2:
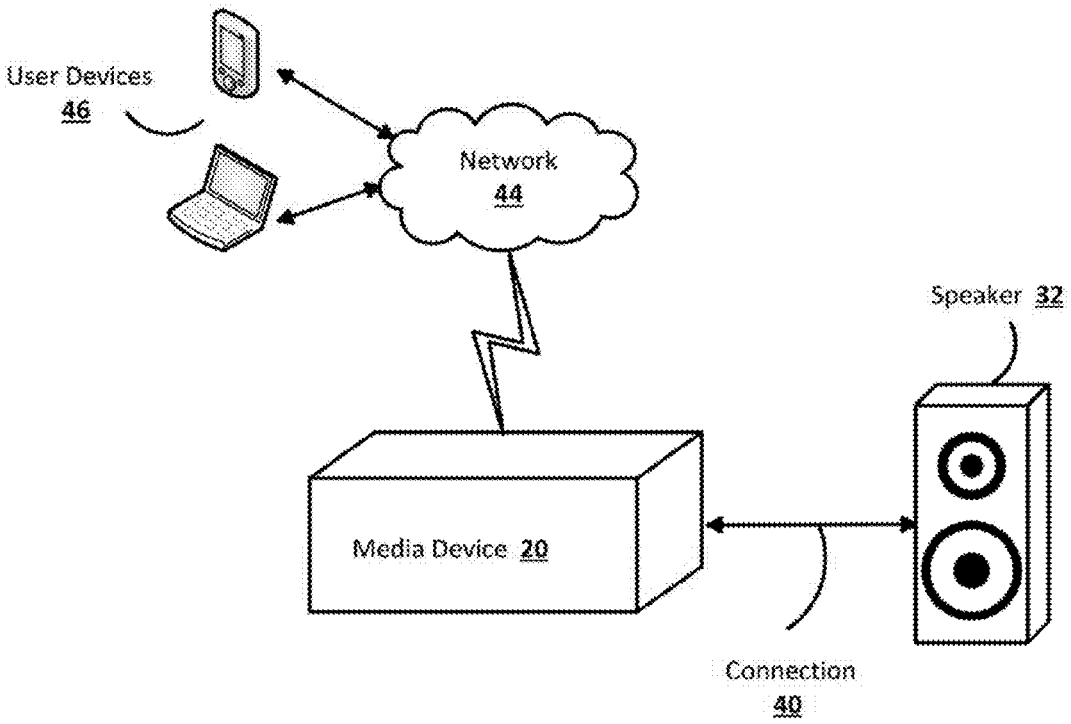
FIG. 2 shows a system according to an implementation of the disclosed subject matter.

FIG. 2 shows a system according to an implementation of the disclosed subject matter. The media device 20 may connect to a speaker 32 via a connection 40. The media device 20 may also connect to a network 44. The network may be a local network, wide-area network, the Internet, or any other suitable communication network, and may be implemented on any suitable platform including wired and/or wireless technologies. User devices 46, such as local computers, smart phones, tablet computing devices, and the like may connect to the network 44 and may provide control and display functions for the media device 20.

The speaker 32 (or "loudspeaker") may be an electroacoustic transducer that produces sound in response to an electrical audio signal input. The speaker 32 may refer to individual transducers (known as "drivers") or to a speaker system comprising an enclosure including one or more drivers. The speaker system may be a standalone speaker including, for example, a bookshelf or floor standing type speaker. The speaker 32 may employ more than one driver for different frequency ranges. For example, the speaker 32 may include one or more subwoofers (for very low frequencies); woofers (low frequencies); mid-range speakers (mid-range frequencies); and tweeters (high frequencies). The speaker 32 may include a crossover for separating an incoming audio signal into different frequency ranges for routing to the appropriate driver. The speaker may also include an identification filter for identifying a speaker model as discussed further herein. A speaker 32 including more than one driver and may, for example, be a two-way speaker (i.e. two drivers), including for example, a woofer and a tweeter, a three-way speaker, including a woofer, a mid-range, and a tweeter, and the like. The speaker 32 may employ various technologies. For example, the speaker 32 may also be an electrostatic, piezoelectric, flat panel, digital, and the like type speaker.

A connection 40 couples the media device 20 to the speaker 32. The connection 40 may be utilized for communicating with the speaker 32, driving and/or powering the speaker 32, and other functions. The connection 40 may be any suitable physical connection including speaker wire. The speaker wire may comprise two or more electrical conductors and may conform to a particular standardized wire gauge, for example, American Wire Gauge (AWG). The gauge of the wire may depend on the application and/or configuration of the speaker 32 (e.g. 12 AWG, 14 AWG, etc). The speaker wire may be marked to identify audio signal polarity and may be include some form of color indicators. For example, a red marking may indicate an active or positive terminal and a black marking may indicate an inactive (e.g. reference or return) or negative terminal. The speaker wire may also conform to proprietary manufacturer or branded wiring specifications and types.

Figure 3:
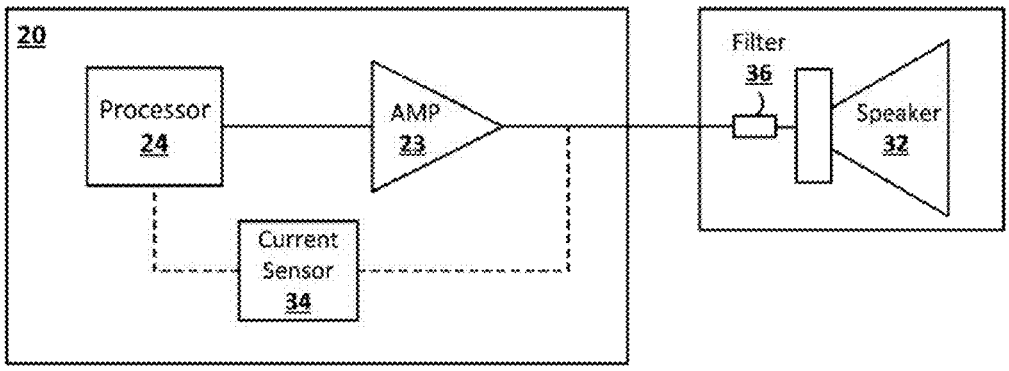
FIG. 3 shows a block diagram of a system determining characteristics of a speaker according to an implementation of the disclosed subject matter.

FIG. 3 shows a block diagram of a system for determining characteristics of a speaker according to an implementation of the disclosed subject matter. The media device 20 may include a processor 24 for providing a signal to an amplifier 23, which may include information representing, for example, music. The amplifier 23 may in turn produce a signal capable of driving a speaker 32 coupled to the media device 20. A current sensor 34 may measure a change in current across a component. For example, driving the amplifier 23 with a signal at a specific frequency and magnitude causes an increase in current, which can be measured by the current sensor 34. The current sensor 34 may be any suitable component to measure a current such as a series resistor, current transformer, and Hall effect sensor. The signal to the speaker 32 may pass through a filter 36, which may include a passive audio crossover. The filter 36 may include a Butterworth, Chebyshev, Elliptic, or other type of filter. The one or more components of the filter 36 may generate an impedance signature at a predetermined frequency or frequency range. This signature may be an identifier that provides information about the speaker model or other characteristics. For example, the speaker model may include a manufacturer name and model type, or may include an identifier (e.g. model number) for identifying the specific speaker.

In an implementation, the filter 36 may include an identification filter for identifying the speaker or other characteristics. The identification filter may include passive or active electronic components that generate an impedance signature. The impedance signature may include unique and distinctive impedance characteristics. In an implementation, a resonant filter or notch filter may be included to generate an impedance peak or impedance notch at a particular frequency or within a particular frequency range. The magnitude and/or number of peaks, notches, or valleys may provide a unique impedance characteristic allowing for identification of a specific speaker. One or more of these filters may be implemented in the same speaker 32.

In another implementation, active electronic components may be included, with or without battery power, to produce the identifying impedance signature. In an implementation, a battery powered filter in the speaker 32 may detect a probing signal from the amplifier 23. In response, the identification filter returns a unique current signal to the amplifier 23.

In implementations, the identification filter may be a specialized component used only to identify the speaker. For example, the identification filter may not produce an audible effect and may not otherwise effect audio performance of the speaker 32 within typical audible ranges. An "audible range" as described herein relates generally to a range perceptible by humans. For example, a speaker 32 may include an identification filter producing no audible effect for identification purposes and also include other filters such as a crossover for improving audio performance. A media device 20 may be able to distinguish between the different types of filters based on the impedance characteristics at various frequency ranges.

The impedance signature generated by the filter 36 may also provide information regarding characteristics of the speaker. The characteristic information may include specifications relating to the speaker 32. For example, the characteristic information may include speaker or driver type information including, for example, whether the speaker 32 is a full-range, mid-range, woofer, or tweeter type speaker. The characteristic information may also include information regarding the number of drivers and the size of the individual drivers. For example, for cone drivers, the size may be the outside diameter of the basket. The characteristic information may include power handling capabilities typically measured in Watts. The power handling capability information may include measurements for continuous power ("RMS," root mean square), average power, and maximum (or peak) power that a speaker can handle (e.g. maximum input power before damaging the speaker). Characteristic information may include frequency response. Frequency response may include a variance limit measured in decibels (e.g. within ±2.5 dB (decibels)). Characteristic information may include impedance, which may be measured in ohms (e.g. 4Ω (ohms), 8Ω, etc). Characteristic information may also include the number of drivers, baffle or enclosure type (e.g. sealed, bass reflex, etc.), crossover frequencies, thiele/small parameters (e.g. resonance frequency), sensitivity, dispersion, and product information. Product information may include product type, identifiers, manufacturer name, and other information describing the product. Product information may also include manufacturer specific or proprietary information and protocols. The characteristic information may also include preference settings that may be set by a manufacturer, such as equalization settings. This preference information may also be set or updated by a user. More generally, the characteristic information obtained in implementations disclosed herein may include any relevant information about one or more speakers in a system such as those shown in FIGS. 1-3 that may be used to adjust audio signals sent to the speakers to obtain an optimal, acceptable, or desired level of performance from the one or more speakers.

FIGS. 1-3 are merely example configurations of a media device 20 and a speaker 32. These configurations are not exhaustive of all the components used or their arrangements within these devices and are intended to be example, non-limiting, configurations of the components. There may, for example, be additional or fewer components and these may interact in various ways known to person of ordinary skill in the art.

Figure 4:
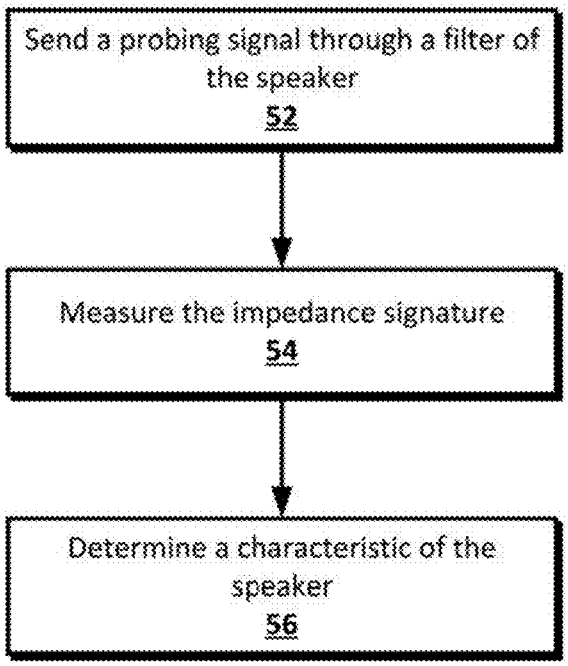
FIG. 4 shows a process flow of determining a characteristic of the speaker using a probing signal according to an implementation of the disclosed subject matter.

FIG. 4 shows a process flow of determining a characteristic of the speaker using a probing signal according to an implementation of the disclosed subject matter. Once a connection between the media device 20 and a speaker 32 is established, the media device 20 in 52 may send a probing signal through a filter of the speaker 32. Establishing a connection may involve coupling the media device 20 with the speaker 30 through a physical connection such as by speaker wire as described herein. The probing signal may be initiated by the processor 24 through the amplifier 23 and through the filter 36 of the speaker 32. The probing signal may be outside the normal frequency range perceptible by humans, which is typically known as between 20 Hz to 20,000 Hz.

The probing signal may be a specific signal type may or may not be distinguishable from an audio signal that is used to drive the speaker 32. For example, the speaker 32 may be able to identify the signal as a probing signal instead of an audio signal. In this case, the probing signal may be distinguishable from an audio signal in varying ways. Typically, the speaker 32 may distinguish a probing signal from an audio signal based on frequency although other techniques may also be used such as varying the voltage. Implementations may include employing signal thresholds for distinguishing between a probing signal and an audio signal. For example, the signal may employ a frequency below or above a specified level as an indication that it is a probing signal. For example, the frequency range may include infrasound, which is typically a frequency lower than 20 Hz, or ultrasound, which is typically a frequency above 20,000 Hz.

In addition, implementations may involve the speaker 32 not distinguishing a probing signal from an audio signal. This provides the benefit of a speaker 32 not needing to process a probing signal differently other than how it may be handled by the filter 36.

Initiating a probing signal may occur at predefined times according to a particular application. The process may occur upon the media device 20 detecting that a speaker 32 has established a connection. The process may occur upon an initialization (e.g. initial installation), a user specified action (e.g. user indicates a new speaker 32 has been connected), upon the powering-up of either device, or at a preset or adjustable interval. In addition, the media device 20 may detect that the speaker 32 is a newly connected device, in which case it may initiate a probing signal. The media device 20 may also recognize a particular speaker. The media device 20 may store a unique identifier assigned to a speaker 32 and may maintain a database storing information for each type of speaker. For example, the media device 20 may detect that the speaker 32 was previously connected and may maintain current output settings or may retrieve saved settings.

In step 54, a current sensor 34 may measure an impedance signature generated by the filter during the duration of the signal. This signature may contain information that a processor 24 may analyze. In 56, a processor 24 may determine a speaker model and/or one or more characteristics of the speaker based on the measured impedance signature. Based on the determined characteristics, output settings (e.g. DSP settings) to the speaker 32 may be adjusted or optimized. One characteristic may include whether the speaker 32 is compatible with the media device 20. For example, a compatibility check may verify that the power rating of the speaker 32 is appropriate for the amplifier 23 of the media device 20. If the devices are not compatible, the media device 20 may return an error message, refuse to drive the speaker 32, notify a user of the incompatibility, or operate in a limited manner. If the media device 20 has a display, the message may be displayed on such a display, or the message may be relayed to one of the user devices 46 (e.g. smart phone) over the network 44, or to another display device (e.g. TV) connected to the media I/O interface 25.

The output setting may also include optimizing the output to the speaker 32. For example, the processor 24 may adjust one or more output settings based on characteristic information of the speaker 32. These output settings may include DSP setting such as equalization settings. The processor 24 may also adjust output settings for an amplifier 23 that may drive the speaker 32. For example, the processor 24 may optimize the gain of the amplifier 23 based on the power handling capabilities of the speaker 32. As described above, the power handling capabilities may include continuous power, average power, and maximum power. For instance, in the example above, the gain of the amplifier may be adjusted in order to prevent exceeding 25 Watts of output in order to prevent damage to the speaker 32. The frequency settings of the amplifier 23 may also be adjusted. In a broad sense, an audio signal to the audio output device 30 may be adjusted in any manner according to determined characteristics of the speaker 32.

Output settings may be derived from the characteristic information itself, or in combination with preprogramed logic or user defined settings. In addition, output settings may be supplemented with information from an external source. For example, the characteristic information may include a product, manufacturer, or model identification and the media device 20 may access the network 44 (e.g. Internet) and download, store, or update specific output settings to the particular speaker model type. Preferences for output settings may also be stored as profile information in the media device 20. The profile information may be associated to, for example, a user or a particular speaker.

Figure 5:
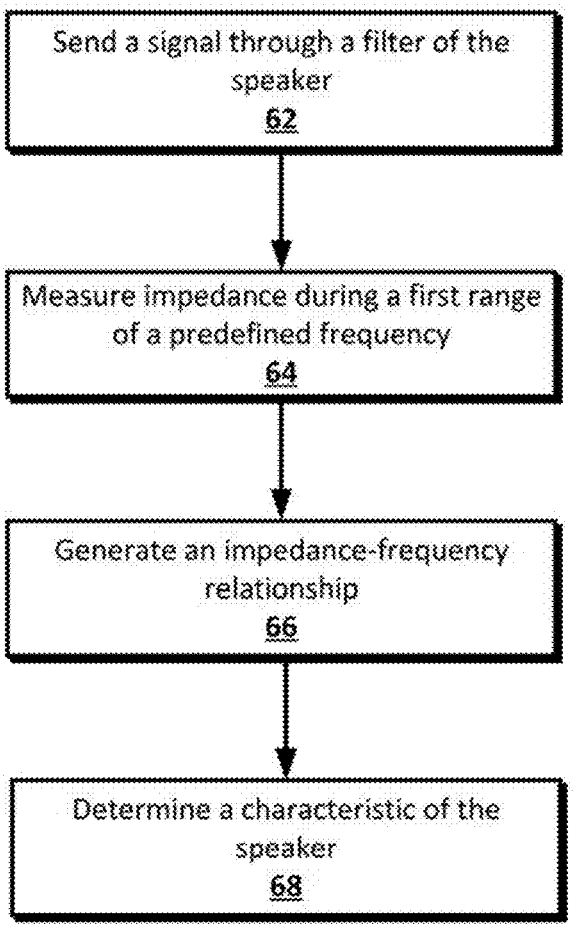
FIG. 5 shows a process flow of determining a characteristic of a speaker by generating an impedance-frequency relationship according to an implementation of the disclosed subject matter.

FIG. 5 shows a process flow of determining a characteristic of a speaker by generating an impedance-frequency relationship according to an implementation of the disclosed subject matter. In 62, the processor 24 may send a signal through the filter 36 of the speaker 32. The signal may progress through a predefined frequency range including a first range and a second range. The first range may include ranges outside of an audible range (e.g. infrasound and ultrasound), and the second range may include the range within an audible range (e.g. 20 Hz to 20,000 Hz). In 64, the current sensor 34 may measure an impedance during the duration of the signal. The impedance may vary based on the filter 36 during the first frequency range of the signal. In 66, the processor 24 or other unit may generate an impedance-frequency relationship based on the measured impedance. The relationship may be a provided or visualized as a frequency vs. relationship curve as will be described hereinafter in FIGS. 6 and 7. In 68, a characteristic of the speaker 32 may be determined based on the generated impedance-frequency relationship. In some cases, the generated relationship may be generated from an identification filter in which case the determined characteristic may be a speaker model.

Figure 6:
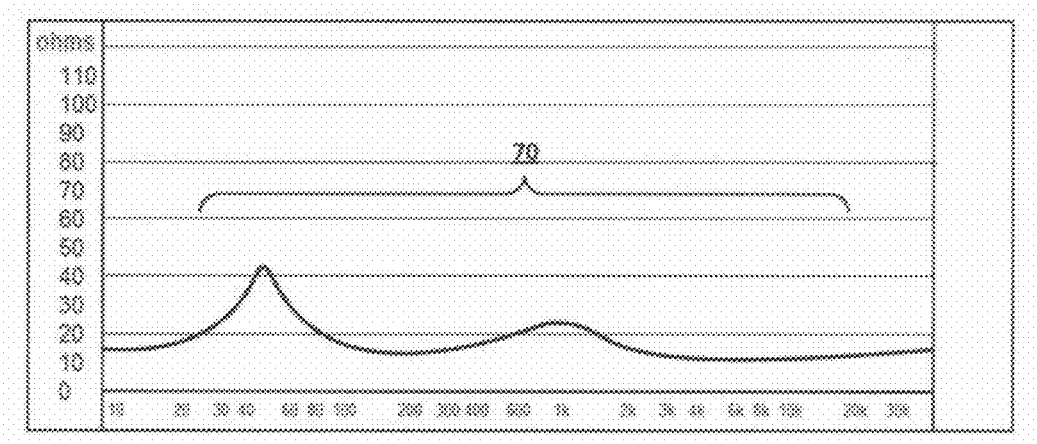
FIG. 6 shows an example impedance vs. frequency curve for a speaker without a filter according to an implementation of the disclosed subject matter.

FIG. 6 shows an example impedance vs. frequency curve for a speaker without an identification filter according to an implementation of the disclosed subject matter. As shown, the curve provides information within the audile range 70 of approximately 20 Hz to 20,000 Hz. As shown, outside of this range, the curve is relatively smooth. Based on analyzing this curve, characteristics of the speaker 32 may be determined. For example, two impedance peaks may be identified indicating the speaker 32 has a two-driver design. Based on the shape of the low frequency impedance peak at approximately 60 Hz, an analysis may determine that a midbass (e.g. woofer) driver of about 5-6 inches in size is included in the speaker 32. An analysis of this low frequency peak may also reveal that the midbass driver may not be capable of producing lower end frequencies (e.g. deep bass). Accordingly, DSP settings may, for example, include a high pass filter at approximately 45 Hz to prevent speaker damage from low-end frequency signals.

An another example, an impedance peak at a frequency of 30 Hz or below would indicate a speaker that includes a subwoofer or high performance woofer of substantial size and power handling. A speaker like this can handle increased power in the low frequency range (e.g. deep bass). Accordingly, DSP settings may, for example, include bass boost in the 20-80 Hz range. Additionally, an impedance peak that occurs at the highest frequency may correspond to a tweeter. If this peak occurs at a relatively low frequency, for example below 800 Hz, the tweeter may be large in size and may have limited high frequency response. This tweeter may benefit from enhanced or boosted input voltage in the top octave such as 10 k-20 k Hz. It should be noted that the adjustments described above are examples and other settings may be adjusted based on impedance or other characteristics known to a person of ordinary skill in the art.

Figure 7:
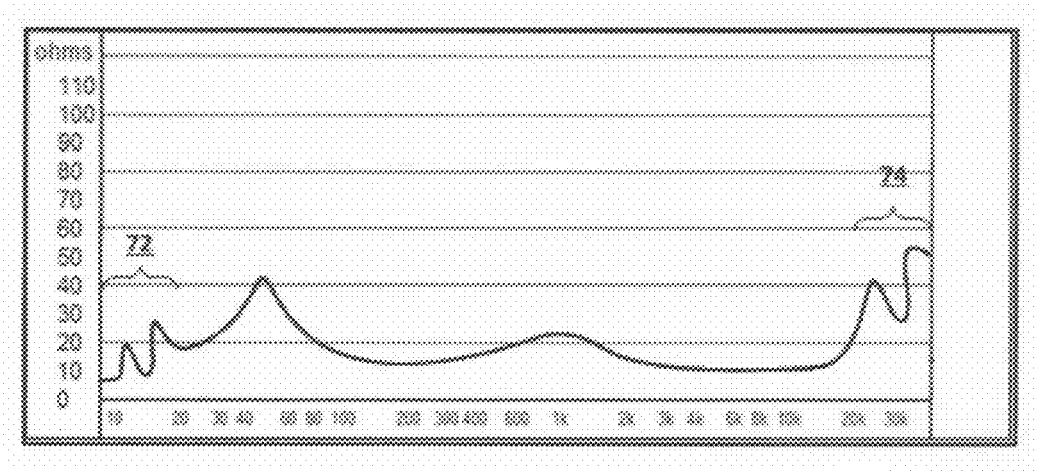
FIG. 7 shows an example impedance vs. frequency curve for a speaker with an identification filter according to an implementation of the disclosed subject matter.

FIG. 7 shows an example impedance vs. frequency curve for a speaker with an identification filter according to an implementation of the disclosed subject matter. More specifically, FIG. 7 shows an example impedance vs. frequency curve of a speaker 32 with the same audio performance characteristics as shown in FIG. 6. As shown, the curve provides a signature outside of an audible range, approximately in an infrasonic frequency range 72 (e.g. below 20 Hz) and an ultrasonic frequency range 74 (e.g. above 20,000 Hz). This signature may provide information such as a model type of the speaker. In addition, all frequency ranges may be used in conjunction to determine characteristics of the speaker as shown. For example, the signature outside of the audible range (e.g. 72 and 74) may indicate that the speaker is of model type A, which is known to include a two-driver design. The curve within the audible range 70 may confirm that the speaker 32 has two functioning drivers. Any deviation from the expected curve may provide an indication that the speaker 32 may not be functioning properly or may otherwise be damaged. For example, one improper functioning mode may include a speaker driver to become "blown" from repeated use or from input power exceeding the speaker specification. In this case, very high impedance will be apparent over the region of the frequency range corresponding to that driver.

This failure may be identified from a single impedance curve. Alternatively, a new impedance curve may be compared against previous impedance measurements and the inconsistency may indicate a failure.

Another improper functioning mode may include the wires connecting the speaker 32 to the media device 20 to become disconnected. In this case, no impedance curve will be generated. Alternatively, the speaker wires may come into contact with one another while connected to the speaker or while disconnected. In both cases, very low impedance will be measured across a wide frequency band.

As previously described, signatures such as those shown in FIGS. 6 and 7 may be used to determine a characteristic of a speaker directly, i.e., based upon the impedance-frequency relationship. Alternatively or in addition, they may be used to identify a speaker or type of speaker, and obtain a characteristic based upon stored or obtained data for the identified speaker or type of speaker. For example, a stored profile, remote or local database, or similar data store may be accessed to obtain a speaker characteristic based upon an identified signature.

The flow diagrams described herein are just examples. There may be variations to these diagrams or the steps (or operations) described therein without departing from the implementations described. For instance, the steps may be performed in a differing order, or steps may be added, deleted or modified.

References to "one implementation," "an implementation," "an example implementation," and the like, indicate that the implementation described may include a particular feature, structure, or characteristic, but every implementation may not necessarily include the particular feature, structure, or characteristic. Moreover, such phrases are not necessarily referring to the same implementation. Further, when a particular feature, structure, or characteristic is described in connection with an implementation, such feature, structure, or characteristic may be included in other implementations whether or not explicitly described. The term "substantially" may be used herein in association with a claim recitation and may be interpreted as "as nearly as practicable," "within technical limitations," and the like.

The foregoing description, for purpose of explanation, has been described with reference to specific implementations. However, the illustrative discussions above are not intended to be exhaustive or to limit implementations of the disclosed subject matter to the precise forms disclosed. Many modifications and variations are possible in view of the above teachings. The implementations were chosen and described in order to explain the principles of implementations of the disclosed subject matter and their practical applications, to thereby enable others skilled in the art to utilize those implementations as well as various implementations with various modifications as may be suited to the particular use contemplated.

The invention claimed is:

1. A method of determining characteristics of a speaker, comprising:

sending a probing signal through a filter of the speaker, the probing signal progressing through a frequency range and producing no audible effect from the speaker;

measuring an impedance signature generated by the filter during a duration of the signal; and determining a characteristic of the speaker based on at least one impedance peak of the measured impedance signature.

2. The method of claim 1, wherein the frequency range is one of an infrasonic frequency range and an ultrasonic frequency range.

3. The method of claim 1, wherein the filter is a passive audio crossover.

4. The method of claim 1, wherein the filter is powered by a battery of the speaker.

5. The method of claim 1, wherein the determined characteristic is a speaker model.

6. The method of claim 1, wherein the determined characteristic includes information relating to at least one of an impedance, frequency response, sensitivity, dispersion, driver type, number of drivers, size, and enclosure type.

7. A method of determining characteristics of a speaker, comprising:

sending a signal through a filter of the speaker, the signal progressing through a predefined frequency range, the predefined frequency range including a first range and a second range;

measuring an impedance during a duration of the signal, the impedance varying based on the filter during the first range of the predefined frequency range;

generating an impedance-frequency relationship based on the measured impedance; and determining a characteristic of the speaker based on at least one impedance peak of the generated impedance-frequency relationship during the first range of the predefined range.

8. The method of claim 7, wherein the filter is a passive audio crossover.

9. The method of claim 7, wherein the generated relationship is an identification signature for the speaker, and wherein the determined characteristic is a speaker model.

10. The method of claim 7, wherein the determined characteristic includes information relating to at least one of an impedance, frequency response, sensitivity, dispersion, type, number of drivers, size, and enclosure type.

11. The method of claim 7, wherein the second range is substantially between 20 Hz and 20,000 Hz.

12. The method of claim 7, further comprising determining a number of drivers for the speaker based on a number of peaks in the generated impedance-frequency relationship during the second range of the predefined range.

13. The method of claim 7, further comprising determining damage to one or more drivers of the speaker based on the generated impedance-frequency relationship during the second range of the predefined range.

14. The method of claim 7, wherein the first range is an infrasonic frequency range.

15. The method of claim 7, wherein the first range is an ultrasonic frequency range.

16. A multimedia device, comprising:

a media interface for connecting to a speaker; and a processor, the processor configured to:

send a probing signal through a filter of the speaker, the probing signal progressing through a frequency range and producing no audible effect from the speaker;

measure an impedance signature generated by the filter during a duration of the signal; and determine a characteristic of the speaker based on at least one impedance peak of the measured impedance signature.

17. The device of claim 16, wherein the frequency range is one of an infrasonic frequency range and an ultrasonic frequency range.

18. The device of claim 16, wherein the filter is a passive audio crossover.

19. The device of claim 16, wherein the determined characteristic is a speaker model.

20. The device of claim 16, wherein the determined characteristic includes information relating to at least one of an impedance, frequency response, sensitivity, dispersion, driver type, number of drivers, size, and enclosure type.

* * * * *